US006810565B2

(12) United States Patent
Fleissner

(10) Patent No.: US 6,810,565 B2
(45) Date of Patent: Nov. 2, 2004

(54) CLOSING UNIT FOR THE NOZZLE STRIP ON A NOZZLE BEAM FOR HYDRODYNAMICALLY NEEDLING FIBRES OF A WEB OF FABRIC

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 0 days.

(21) Appl. No.: 10/467,319

(22) PCT Filed: Feb. 7, 2002

(86) PCT No.: PCT/EP02/01275

§ 371 (c)(1),
(2), (4) Date: Jan. 12, 2004

(87) PCT Pub. No.: WO02/064872

PCT Pub. Date: Aug. 22, 2002

(65) Prior Publication Data

US 2004/0103506 A1 Jun. 3, 2004

(30) Foreign Application Priority Data

Feb. 14, 2001 (DE) ..... 101 07 403
Mar. 13, 2001 (DE) ..... 101 12 446

(51) Int. Cl.[7] ..... D04H 1/46
(52) U.S. Cl. ..... 28/104; 28/167
(58) Field of Search ..... 28/104, 167, 105; 239/553.3, 553.5, 590.3, 590.5, 600, 566, 597, 568; 68/205 R

(56) References Cited

U.S. PATENT DOCUMENTS 3,403,862 A * 10/1968 Dworjanyn ..... 28/104
3,613,999 A * 10/1971 Bentley et al. ..... 239/553.3
4,085,485 A * 4/1978 Brandon et al. ..... 28/104
4,880,168 A * 11/1989 Randall et al. ..... 239/553.5
5,042,722 A * 8/1991 Randall et al. ..... 28/105
5,692,278 A * 12/1997 Fleissner ..... 28/105
5,778,501 A * 7/1998 You ..... 28/104
6,012,654 A * 1/2000 Fleissner ..... 28/105
6,105,222 A * 8/2000 Fleissner ..... 28/104

FOREIGN PATENT DOCUMENTS

DE 19501738 * 7/1996

* cited by examiner

*Primary Examiner*—Amy B. Vanatta
(74) *Attorney, Agent, or Firm*—Antonelli, Terry, Stout & Kraus, LLP

(57) ABSTRACT

During the construction of the nozzle beam according to DE-A-195 01 738, the insertion slit for the nozzle strip (14) is sealed on the front side of the nozzle beam by means of a screwed cover (16,17). It is easier to exchange a nozzle strip (14) if a special closing unit (26) having an opening (3) for the nozzle strip is provided on the front side, and said opening (30) is closed in a liquid-tight manner by a simply fixed insertion mandrel (31).

19 Claims, 4 Drawing Sheets

CT/EP02/01275

CLOSING UNIT FOR THE NOZZLE STRIP ON A NOZZLE BEAM FOR HYDRODYNAMICALLY NEEDLING FIBRES OF A WEB OF FABRIC

The invention relates to a jet manifold on a device for generating extremely fine fluid jets used in the hydrodynamic jet impingement of fibers of a web moving along the manifold, such as a fiber web, tissue, etc., or a woven or knit, which manifold is composed of an upper section extending over the working length of the web, and of a lower section, wherein a. a pressure chamber of round cross-section is located along the length of the upper section, the fluid being supplied under pressure, for example, to the front side of the chamber;

b. a pressure distribution chamber is provided in the lower section in parallel to the above;

c. the pressure distribution chamber discharges into a narrow fluid outlet slit opposite the cross-section of the pressure distribution chamber;

d. a jet strip is mounted in a fluid-tight fashion within the jet manifold above the fluid outlet slit; and e. this jet strip may be replaced through a closable opening on the front side of the jet manifold.

A device of this type is disclosed in German Patent 195 01 738, the content plus drawings of which are referenced here as prior art. Within the pressure chamber, water pressures of up to 1,000 bar are generated which, of course, act on the end walls of the jet manifold. In order to produce the orifices in the manifold, the one front side must initially be open, then closed by covers. Special covers are provided for the pressure chamber as well as the pressure distribution chamber, the covers being attached by screws to the jet manifold wall. A special cover is also provided to close the jet strip replacement opening, this cover also being attached to the jet manifold wall by screws. O-rings recessed in the sealing walls serve to provide a fluid-tight seal.

When replacement of the jet strip is required, the two screws located in it which attach the cover to the manifold are loosened with a screwdriver—after having shut off the water supply—and the cover and screws set aside for reuse. Although only two screws need to be loosened, a screwdriver is still required for this operation, a procedure which may be viewed as disadvantageous.

The goal of the invention is to find a solution for a jet manifold of the type referred to at the outset which allows for the rapid replacement of the jet strip without equipment disassembly and without a screwdriver.

The goal is achieved by f) providing a closing unit on the closable opening which g) is provided at the level of the jet strip mounting position with an insertion slot for the jet strip, which slot h) is closable by an insertion mandrel.

The insertion mandrel may be retained by a bolt secured within the closing unit, which bolt may be easily removed from a hole retaining the insertion mandrel in the jet manifold after shutting off the water supply and thus the water pressure. Loss of the bolt may be prevented by securing it to the jet manifold using, for example, a thread-like link; the insertion mandrel may be removed by hand from the closing unit, preferably along with the jet strip, and the same items may then be inserted along with the insertion mandrel after replacement with a new strip.

An example of a jet manifold of the type enhanced according to the invention is shown in the drawings.

Figure 1:
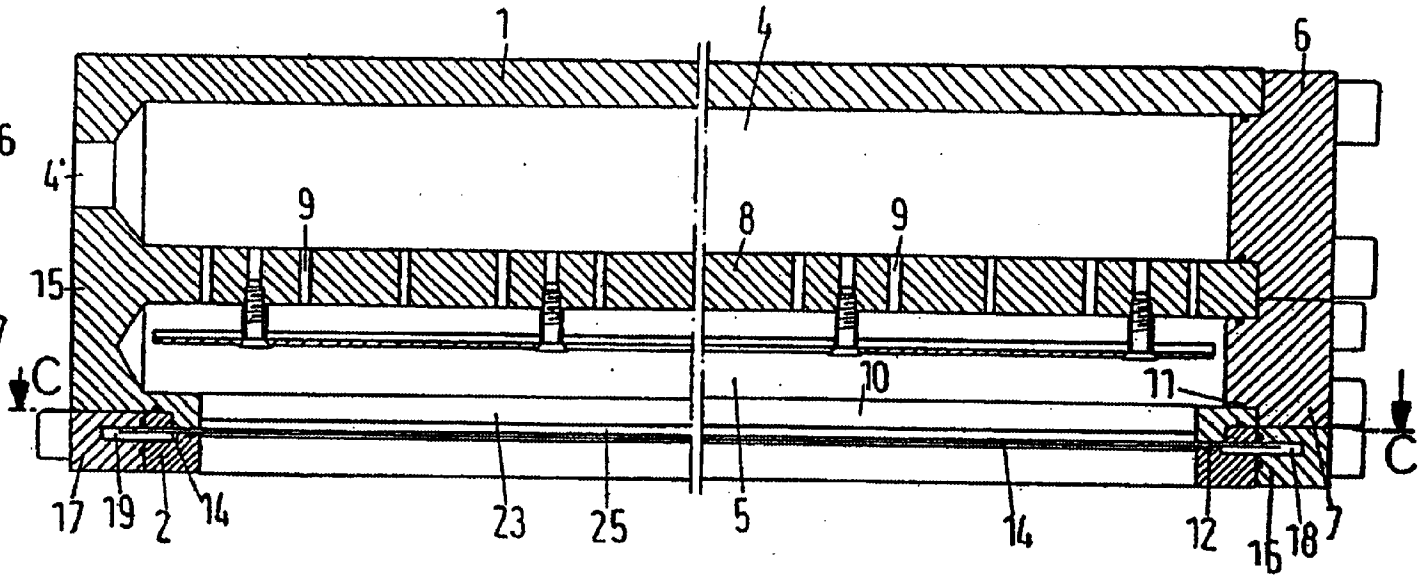
Fig.1 (PRIOR ART)
FIG. 1 shows a section through a conventional jet manifold.
Figure 2:
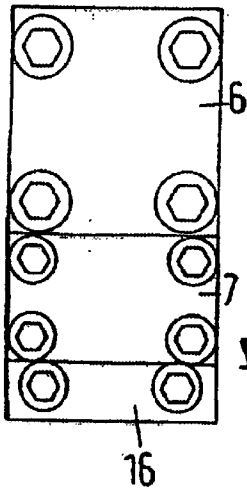
Fig.2 (PRIOR ART)
FIG. 2 is a view of the front side of the jet manifold in FIG. 1.
Figure 3:
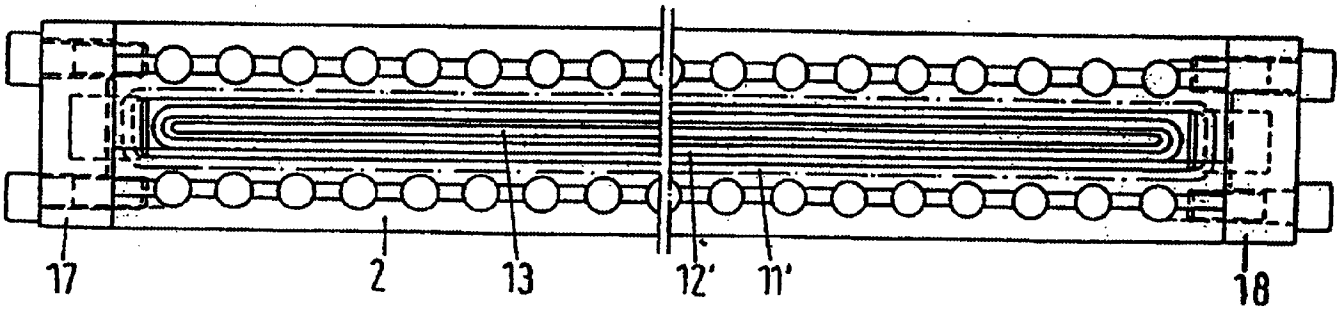
Fig.3 (PRIOR ART)
FIG. 3 shows a section along line C—C in FIG. 1 providing a view of the lower section of the jet manifold.

The jet manifold seen in FIGS. 1–3 is disclosed in German Patent 195 01 738, but may be replaced by another item working on a similar principle. The housing of the jet manifold is composed of an upper section 1 which is attached to the lower section 2 at multiple sites over its length from below by screws, not shown. Upper section 1 has two longitudinal cavities 4 and 5, of which the upper one is the pressure chamber 4 and the lower one is the pressure distribution chamber 5. Both chambers are open at the one front side but are closed by screw-attached covers 6 and 7 forming a liquid-tight seal. At the other end, pressure chamber 4 has an opening 4' through which liquid is introduced under pressure. The two chambers 4 and 5 are separated by a partition 8. A large number of passages 9 in partition 8 over the length of the jet manifold connect the two chambers, thus allowing the fluid entering pressure chamber 4 to discharge into pressure distribution chamber 5 in a uniformly distributed manner over its length. The pressure distribution chamber is open at the bottom as a result of a slot 10, which slot is narrow relative to the diameter of the cavity of pressure distribution chamber 5 and also extends the length of the manifold.

Upper section 1 is permanently screwed onto lower section 2 forming a fluid-tight seal. The seal is created by the O-ring 11 which is inserted in an annular groove 11' of upper section 1. At the center between O-ring 11, slot 10 surrounds a spring projection 23 which is fitted into an appropriate groove 25 of lower section 2. Another annular groove 12' is incorporated in the base of base of groove 25 of lower section 2, in which groove 12' O-ring 12 is inserted to seal jet strip 14. In line and below fluid passages 9 and slot 10, another slot 13 is incorporated in lower section 2, which slot is extremely narrow at the top, providing an opening which is only slightly wider than the width of the effective jet orifices of jet strip 14.

In alignment with covers 6, 7, or with the back housing end wall 15, lower section 2 is screwed on forming a fluid-tight seal by additional covers 16 and 17. One groove 18, 19 each is incorporated in covers 16, 17 at the level of lower jet strip 14 retained in the lower section, into which grooves jet strip 14 projects, thereby allowing it to be easily grasped for removal and replacement after disassembly of covers 16 or 17.

Figure 4:
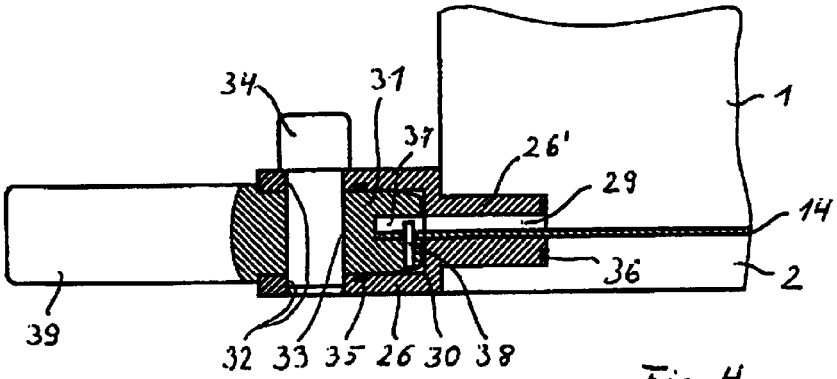
FIG. 4 is a section along line IV—IV in FIG. 5, specifically, one of the two front sides of the jet manifold in FIG. 1 now enhanced by a new rapid replacement device for the jet strip.
Figure 5:
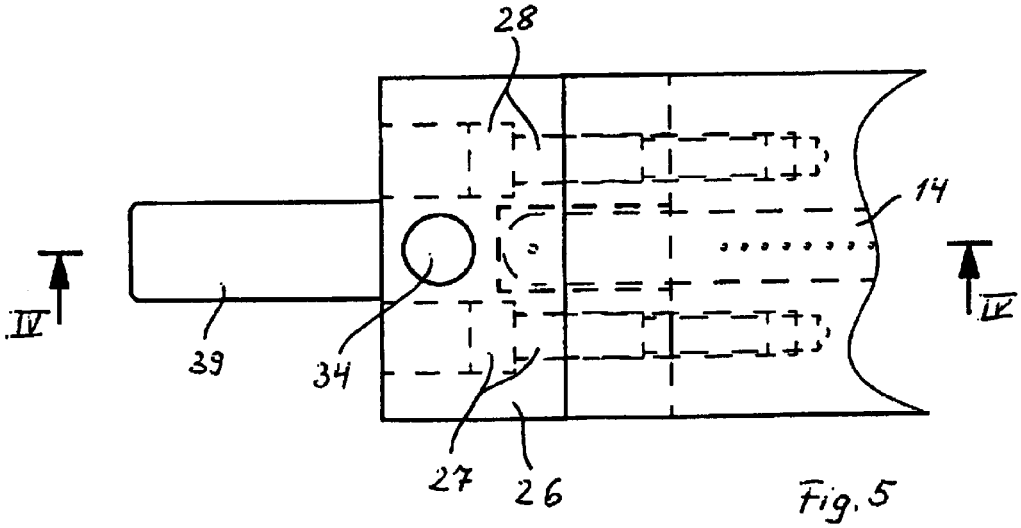
FIG. 5 is a top view of the device in the region of the front side of the jet manifold.

In place of the screw-on covers 16, 17 of FIGS. 1, 2, the screws of which are unscrewed and set aside together with covers 16, 17 during replacement, a projecting closing unit 26 is provided according to FIGS. 4, 5 opposite the front side of upper section 1 of the jet manifold, which unit allows for rapid replacement of jet strip 14. The unit is composed of a block matching the width of the jet manifold, one side of which is permanently screwed onto lower section 2 of the jet manifold by screws 27, 28, and which block includes at the center of this side a continuous slot 29 to allow insertion of jet strip 14. On the other side at the same level is an insertion slot which is open to the outside and allows insertion of jet strip 14 and may be closed by insertion mandrel 31. In order to secure insertion mandrel 31 in the insertion slot which is expanded relative to insertion opening 30, closing unit 26 of FIG. 4 has a hole 32 running continuously from top to bottom which is matched by an aligned hole 33 in insertion mandrel 31 when in the inserted state in insertion opening 30. Insertion mandrel 31 is secured to closing unit 26, and thus to the jet manifold, by these holes 32, 33 passing through parts 26 and 31, and by the bolt 34 inserted therein. Bolt 34 is easily manipulated in its holes 32, 33 by closing unit 26 which projects opposite the front side of the jet manifold.

Insertion mandrel 31 is sealed by an O-ring 35 in insertion opening 30, while block 26 along with its end 26' extending into jet manifold 1, 2 is sealed by a ring gasket 36 at the front side of end 26' within upper section 1 and lower section 2.

In FIG. 4, jet strip 14 is secured in a slot 37 at the end of insertion mandrel 31, for example, by a pin 38 or a friction spring, and may easily be moved back and forth by a grip 39 at the other end of insertion mandrel 31. To replace the jet strip, it is only necessary to remove the water pressure in the jet manifold and withdraw bolt 34. Jet strip 14 may then be easily removed by grip 39, and the new strip inserted after replacement of jet strip 14 is completed. To secure insertion mandrel 31, it is then only necessary to once again insert bolt 34 through holes 32, 33. The water pressure may then be increased.

In the device of FIGS. 6–9 employing the same principle, the rapid replacement device for jet strip 14 has been modified. This device is composed of two spring strips 40, 41 pressed against each other which are attached one above the other to the front side of insertion mandrel 31 and parallel to jet strip 14. Spring strips 40, 41 are bent upward at their free ends as shown in FIG. 9*a*. A short pin or a hemisphere 42 is attached in the region of this bend to lower spring strip 40, which pin or hemisphere penetrates a matching hole 43 in the upper spring strip 41 when spring strips 40, 41 are in contact with each other. One end of jet strip 14 has a corresponding hole 44 through which sphere 42 of spring strip 40 passes in order to retain strip 14 on insertion mandrel 31. As FIG. 9*e* shows, this arrangement allows jet strip 14 to be quickly replaced. The two spring strips 40, 41 are intended to be bent upwards only with the end of jet strip 14, and the replacement procedure for the arrangement is intended to be performed according to FIGS. 9*g* and *h*.

Figure 6:
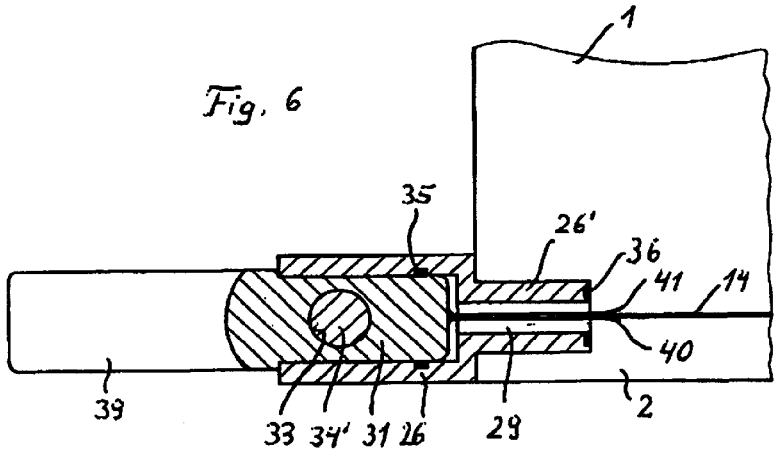
FIG. 6 is a section through the closing unit, similar to that of FIG. 4 with another retainer for the jet strip.
Figure 7:
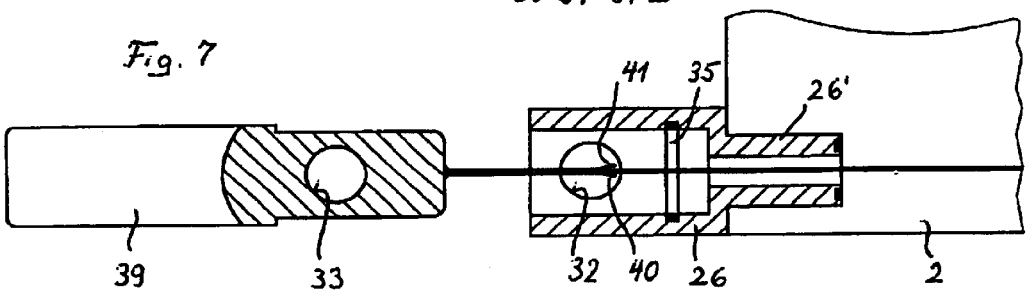
FIG. 7 is a section of the same type as in FIG. 6 with the insertion mandrel removed.
Figure 8:
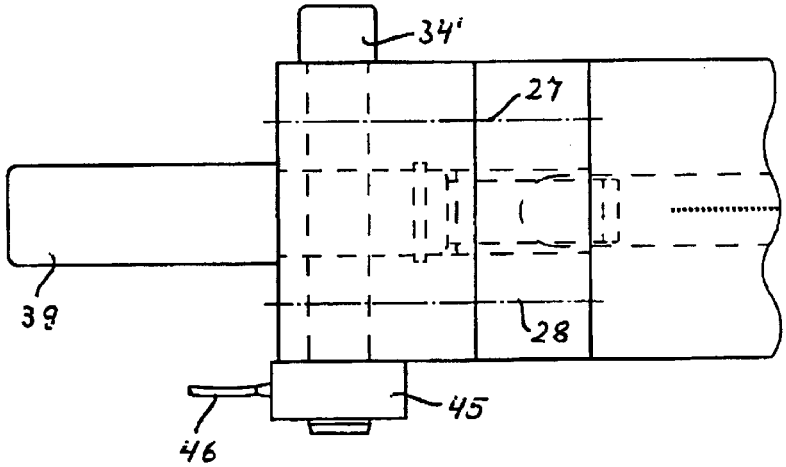
FIG. 8 is a top view of the device according to FIG. 6.
Figure 9:
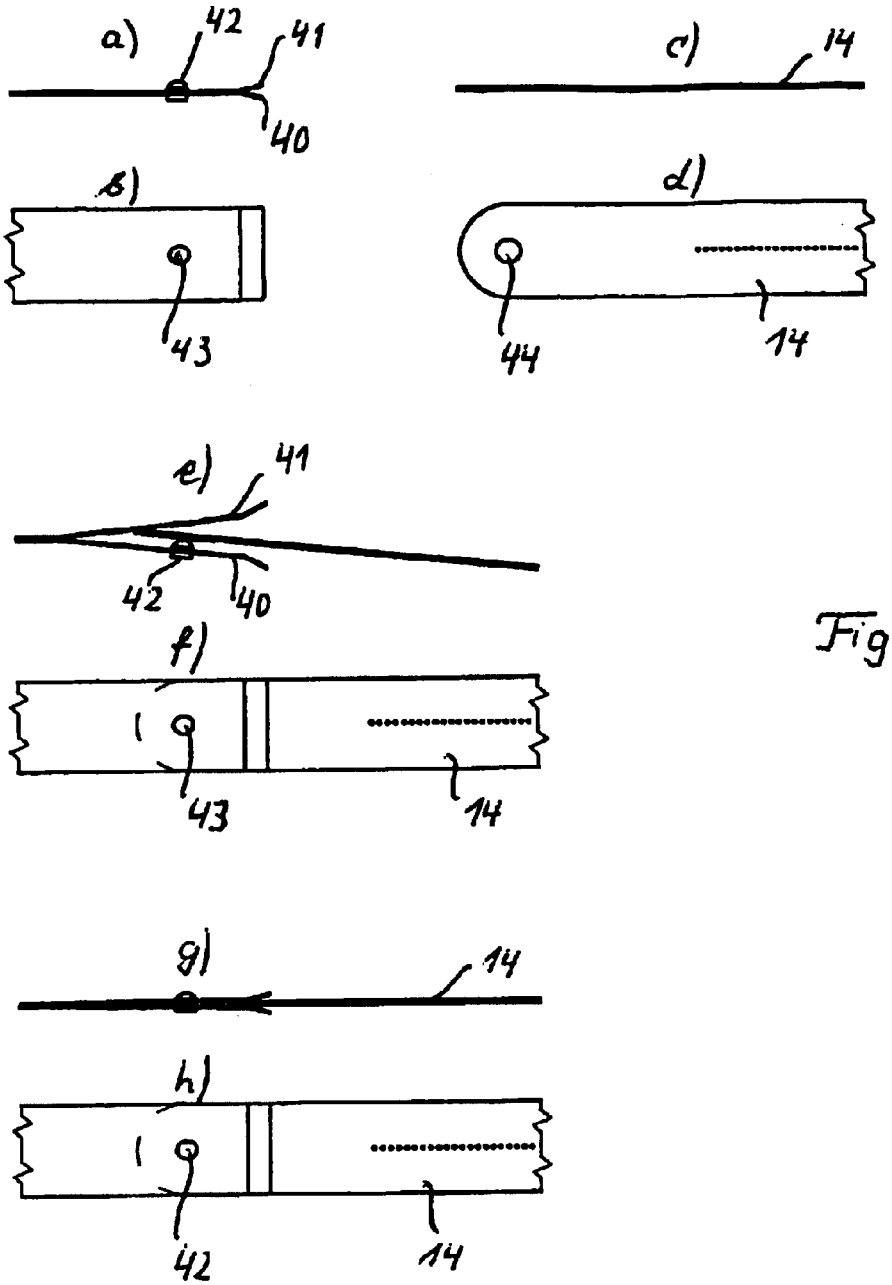
FIG. 9 is a schematic diagram showing the procedure for rapidly attaching the jet strip in the rapid replacement device of FIG. 6.

In the example of FIGS. 6–8, bolt 34' extends horizontally rather than vertically. Bolt 34' thus covers the insertion holes for screws 27, 28; however, these are deeply countersunk and rarely need to be replaced. In addition, the free end of bolt 34' projects from closing unit 26, there passing through ring 45 which functions as a contact sensor for the properly locked closing unit 26. In this regard, the ring 45 laterally attached to closing unit 26 is connected electrically through wires 46 to the control unit of the jet manifold in which the water pressure is increased only when closing unit 26 is properly blocked by bolt 34'.

What is claimed is:

1. Jet manifold on a device for generating extremely fine fluid jets used in the hydrodynamic jet impingement of fibers of a web moving along the manifold, which manifold is composed of an upper section extending over the working length of the web, and of a lower section, wherein a) a pressure chamber of round cross-section is located along the length of the upper section, the fluid being supplied under pressure, the chamber;

b) a pressure distribution chamber is provided in the lower section in parallel to the pressure chamber;

c) the pressure distribution chamber discharges into a narrow fluid outlet slit opposite the cross-section of the pressure distribution chamber;

d) a jet strip is mounted in a fluid-tight fashion within the jet manifold above the fluid outlet slit;

e) the jet strip may be replaced through a closable insertion opening on a front side of the jet manifold, characterized in that f) a closing unit is provided on the closable insertion opening which g) is provided at the level of the jet strip mounting position with an insertion slot for the jet strip, which slot h) is closable by an insertion mandrel.

2. Jet manifold according to claim 1, characterized in that the closing unit (26) projects opposite the front side of the jet manifold (1, 2).

3. Jet manifold according to claim 1, characterized in that the insertion mandrel (31) is retained on the jet manifold (1, 2) by a bolt (34, 34') secured within the closing unit (26).

4. Jet manifold according to claim 3 characterized in that the bolt (34') inserted into the closing unit (26) contacts an operating switch (45, 46) which enables start-up of the jet manifold after contact has been made.

5. Jet manifold according to claim 4, characterized in that the operating switch (45, 46) is attached to the closing unit (26) on the exit side of the bolt (34').

6. Jet manifold according to claim 4, characterized in that the operating switch (45, 46) is composed of an electrically activatable ring (45) which triggers the "on" contact when the bolt (34') is inserted.

7. Jet manifold according to claim 1, characterized in that the insertion slot (29) in the closing unit (26) is enlarged relative to the dimensions of the jet strip (14) and that the insertion mandrel (31) fills the insertion opening (30).

8. Jet manifold according to claim 3, characterized in that the closing unit (26) has a passage (32) oriented vertically to the axis of the insertion opening (30), through which passage the bolt (34, 34') is movable, and that the insertion mandrel (31) has an alignment hole (33) matched to the diameter of the bolt (34, 34').

9. Jet manifold according to claim 1, characterized in that the front side of the insertion mandrel (31) is provided with a retainer for the jet strip (14).

10. Jet manifold according to claim 9, characterized in that the jet strip (14) is attached in an easily replaceable manner to the retainer.

11. Jet manifold according to claim 9, characterized in that the insertion mandrel (31) has a blind slot (37) on its front side which is matched to the jet strip (14).

12. Jet manifold according to claim 11, characterized in that the jet strip (14) is retained in an easily replaceable manner within the blind slot (37).

13. Jet manifold according to claim 9, characterized in that the retainer is composed of two spring strips (40, 41) which are pressed together, are attached to the insertion mandrel (31) and freely project from said mandrel, between which spring strips the jet strip (14) is retained.

14. Jet manifold according to claim 13, characterized in that a spherical projection (42) is attached to one of the spring strips (40), which projection extends into a hole (43) of the opposing spring strip (41).

15. Jet manifold according to claim 9, characterized in that the jet strip (14) has a hole (44) at one end which engages the retainer of the closing unit (26).

16. Jet manifold according to claim 1, characterized in that an O-ring (35) is provided around the circumference of the insertion mandrel (31).

17. Jet manifold according to claim 9, characterized in that a grip (39) is provided on the end of the insertion mandrel (31) opposite the retainer of the jet strip (14).

18. Jet manifold according to claim 1, characterized in that the closing unit (26) projecting opposite the front side of the jet manifold (1, 2) is composed of a block, the lateral ends of which on both sides of the insertion opening are attached by being screwed together (27, 28) to the front side of the jet manifold (1, 2), in the center section of which the insertion slot (29) is provided for the jet strip (14), and this strip is retained there.

19. Jet manifold according to claim 18, characterized in that a free end (26') of the closing unit (26) extending into the jet manifold (1, 2) along a corresponding groove within the jet manifold is sealed (36) relative to the jet manifold (1, 2).

* * * * *